US007568667B1

(12) United States Patent
Feik et al.

(10) Patent No.: US 7,568,667 B1
(45) Date of Patent: Aug. 4, 2009

(54) MOBILE PAINT CONTAINER SUPPORT

(75) Inventors: Frederick Feik, Maple Plain, MN (US); Bruce Clark, Maple Plain, MN (US)

(73) Assignee: American Innovations Corporation, Maple Plains, MN (US)

( * ) Notice: Subject to any disclaimer, the term of this patent is extended or adjusted under 35 U.S.C. 154(b) by 144 days.

(21) Appl. No.: 11/784,618

(22) Filed: Apr. 9, 2007

Related U.S. Application Data

(60) Provisional application No. 60/792,565, filed on Apr. 17, 2006.

(51) Int. Cl.
*A47K 1/04* (2006.01)

(52) U.S. Cl. ..... 248/129; 248/128; 248/685

(58) Field of Classification Search ..... 248/129, 248/154, 346.03, 346.06; 118/504; 401/15; 15/248 A, 248 R; 427/282; 51/310, 274; 280/1.167, 1.183, 1.204, 9, 10, 11, 246, 247, 280/807, FOR. 107; 220/570, 571.1, 737
See application file for complete search history.

(56) References Cited

U.S. PATENT DOCUMENTS 4,325,323 A * 4/1982 Rioux ..... 118/504
D379,701 S 6/1997 Copeland, Sr. ..... D32/53.1

FOREIGN PATENT DOCUMENTS

CA 2511306 A1 * 1/2007

* cited by examiner

*Primary Examiner*—J. Allen Shriver, II
*Assistant Examiner*—Erin Smith
(74) *Attorney, Agent, or Firm*—Westman, Champlin & Kelly, P.A.

(57) ABSTRACT

A rollable support for a paint supply including a roller tray, or a 5-gallon pail, has a support wall that will receive the paint supply desired. The support wall is mounted on suitable rollers at least one end that engages a surface to permit moving the paint supply support across the surface. A pair of non-rolling feet are connected to the paint supply support through pivoting link so that the feet can be moved from a position wherein they engage the surface and lift at least one end of the paint supply support so the rollers at that end of the paint supply support are lifted off the surface, the feet are movable a position wherein the feet clear the floor and the rollers support the paint supply support. As shown, rails forming parallel links comprise the feet and both ends of the paint supply support are raised and lowered. The rails provide a stable mount for the paint container support and any supported paint container when they are lowered.

19 Claims, 10 Drawing Sheets

MOBILE PAINT CONTAINER SUPPORT

This application refers to and claims priority under 35 U.S.C. §119 of U.S. Provisional Patent Application Ser. No. 60/792,565, filed Apr. 17, 2006, the content of which is incorporated by reference.

BACKGROUND OF THE INVENTION

The present disclosure relates to a mobile support for a paint container, such as a roller tray or a can of paint that would primarily be used with a paint roller, and which is operable so that casters or wheels on which it is movably mounted can be lifted from the floor and the paint container will be supported on stable rails or feet directly on a floor, for loading the roller with paint.

Professional painters will use paint rollers in commercial applications, in particular, and also for any large walls. The paint rollers are loaded with paint by rolling them through a paint supplier on a tray, or by dipping the roller in a bucket, after which excess paint can be rolled out on a panel. The quantity of paint that is held on a conventional paint tray is large enough so that before the paint tray is refilled as the painting progresses, there is great deal of moving of the tray as a wall is painted. Sliding the tray or hand moving the can or tray from one location to another is time consuming and is prone to spillage. Having the paint support tray mounted on wheels or casters so it could be rolled across a surface leaves the tray movable and unstable when a roller is placed into the tray, filled with paint, and then excess paint is wiped off.

While time is of the essence when painting, and it is also desirable to minimize spills, or drips on floor areas.

SUMMARY OF THE INVENTION

The present disclosure relates to an easily rollable paint support tray or paint holding tray, which is operable so that it can be moved on casters, wheels or rollers for movement between one location and another, and the casters or wheels are raised so that it is non-rollably supported on the floor or other supporting surface. As shown, rails or runners are lowered, to raise the wheels of casters, but individual legs, feet or other supports can be used. The paint container support is a tray that is of size to hold a 5-gallon pail of paint, or a large paint roller tray of conventional design on a lower planar plate surrounded by upright walls.

The tray itself can contain the paint to be used. The term paint support tray means a tray or flat plate that can hold a supply of paint or support a tray liner, a separate paint tray or a can of paint. The tray also can be called a paint supply support or tray. The paint support tray has casters or rollers at opposite ends thereof, which in one position support the plate to permit it to be rolled across a supporting surface easily. A support assembly or framework is provided and is retracted in one position so that the rollers or casters support the paint support tray on the supporting surface or floor. The support assembly can be quickly moved, through an actuator assembly, as shown pivoting links so that the support rails or feet will engage the floor surface and lift the roller or casters off the floor surface to stabilize and retain the paint support tray (or plate) in a substantially stationary position, without the tendency to roll or slide easily.

The casters or rollers are adjacent ends of the paint support tray as shown. A pair of support rails are adjacent opposite sides the sides of the paint support tray. The support rails are movably mounted to the paint tray through pivoting links so that the support rails can easily be raised and lowered by operating a lever connected to the links. The lever is adapted to be engaged by a paint roller frame or handle, so that the paint roller handle can be used for raising and lowering the paint support tray quickly, easily and conveniently.

The links shown for moving the support rails include pairs of front and rear links on opposite sides of the paint support tray. The pairs of links are mounted to pivot simultaneously so that the links retain their relative orientation as they are pivoted to raise and lower the support rails conveniently. The pivoting links have sufficient lengths so that the casters or rollers on the paint support tray will be raised off the ground in a working position of the support rails or tracks and will be raised to a position wherein the casters or rollers engage the floor. The rails are raised off the floor in a transport position so the paint tray can be moved by rolling the supports across the floor.

Various types of casters, rollers, wheels of the like can be utilized for rolling support, but the type of rolling support shown which includes a rolling ball at the bottom end is preferred. Also, the size of the paint support tray can be varied as needed for the particular application or for receiving standard roller trays or roller tray liners.

DETAILED DESCRIPTION OF ILLUSTRATIVE EMBODIMENTS

Figure 1:
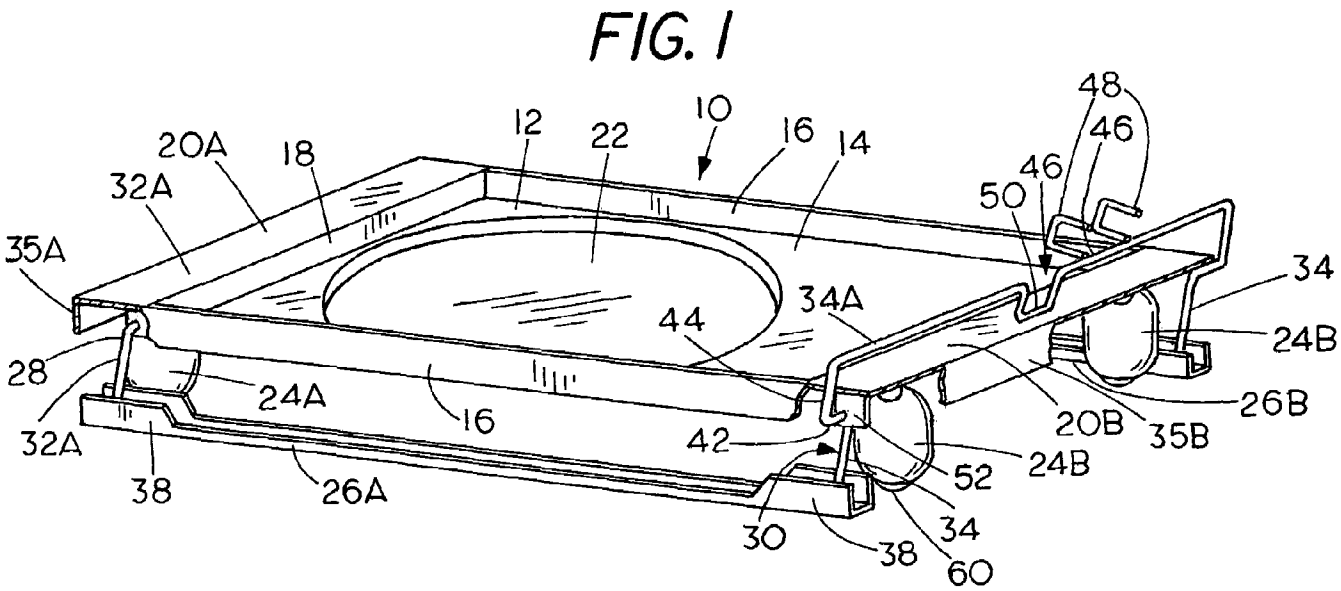
FIG. 1 is a perspective view of a first form of a paint support tray of the present disclosure in a raised position wherein it would be used for loading a roller with paint.
Figure 2:
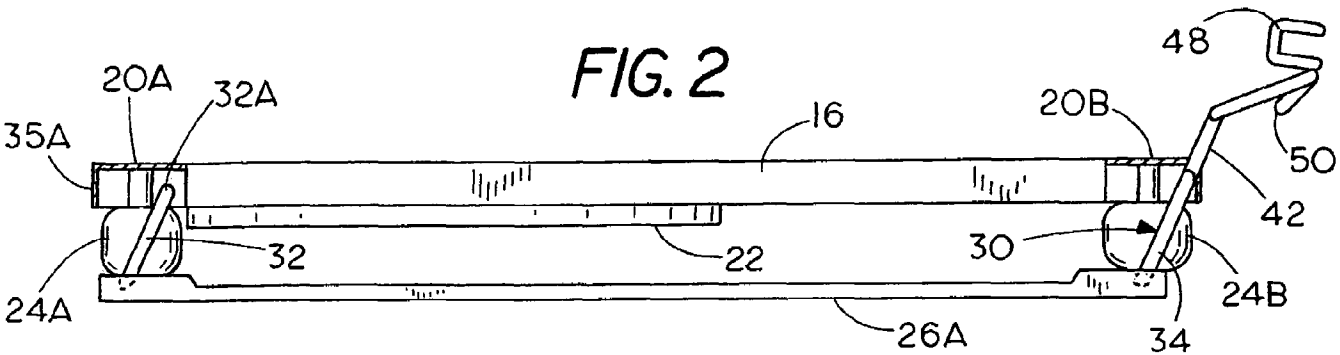
FIG. 2 is a side elevational view of the paint support tray of FIG. 1.

Referring to FIG. 1 a first form of a paint support tray assembly indicated generally at 10 is shown to include a paint support tray 12. The tray 12 has a bottom wall panel 14, attached to upright side walls 16, and upright end walls 18. The end walls 18 each support a horizontal flange 20A and 20B, which flanges are integral with the tray and which are sturdily supported relative to the bottom wall panel 14. Panel 14 as shown, may have a recessed receptacle 22 that is of size to receive and guide a 5-gallon can of paint. The receptacle 22 will keep the bottom of the paint can from sliding back and forth during movement of the paint support tray, and will adequately support a 5-gallon paint can extending above the wall panel 14. Roller adapters for paint cans are now made which will attach to 5 gallon pails for paint roller applications where the roller will be capable of being dipped into the 5-gallon pail or can (with an open top) and then excess paint removed by rolling the roller around an inclined wall that permits paint to drain back into the 5-gallon can.

The flanges 20A and 20B, as shown, each overlie a pair of mobile supports comprising casters wheels or rollers 24A and 24B with the pair of casters or rollers 24A at the front of the tray supported to be under flange 20A and the pair of casters or rollers 24B supported to be under flange 20B.

The casters or rollers can be attached to the paint support tray or walls with any desired fasteners and are shown schematically in molded in or formed receptacles 21 the receive the caster mounting pins 23.

The paint container support assembly 10 further includes stabilizing, non rolling supports, as shown, a framework 25 that has a pair of longitudinally extending support rails or feet 26A and 26B on opposite sides of the paint support tray 12, and as shown spaced to the outside of the side walls 16. These rails 26A and 26B, which also can be called runners or feet, are parallel to each other, and are supported on a first link assembly 28 which as shown is a parallel link assembly, at one end of the paint support tray. A second link assembly 30, which also is a parallel link assembly, supports the paint support tray relative to the rails 26A and 26B at a second end of the paint support tray. The link assemblies include pivoting links 32 and 34 on opposite sides of the paint support tray, respectively. The links 32 and 34 are adjacent to flange 20A and 20B, respectively, and are pivotally mounted in a suitable manner to the paint container support tray 12. The pivotal mounting can be of any desired form, but it is desirable to have a cross shaft 32A to join the links 32 together at the end of the support by flange 20A.

At the other end of the paint support tray, which is an actuator end, cross rod sections 34A are fixed to the links 34. The cross rod sections 34A on opposite sides of the paint support tray are joined to arms 42 and 44 and by a cross rod 46, positioned above the paint container support tray 12. With the cross connections that join the respective links 32 and 34 on the opposite sides of the paint support tray 12, the links will move at the same time and the same amount when the cross shaft 32A and cross shaft sections 34A are pivoted.

Figure 9:
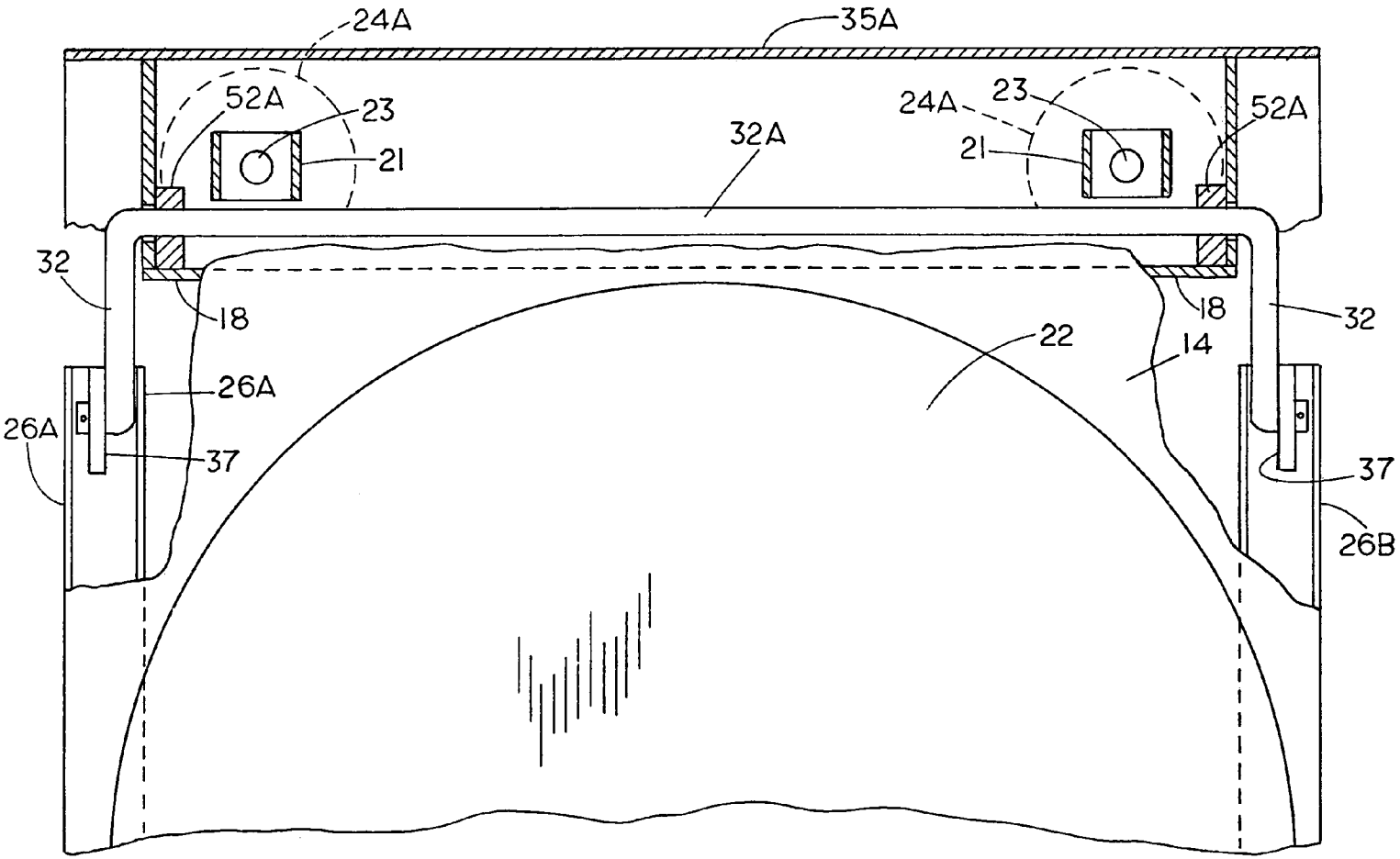
FIG. 9 is an enlarged fragmentary top view of the second end of the paint support tray with parts broken away.
Figure 10:
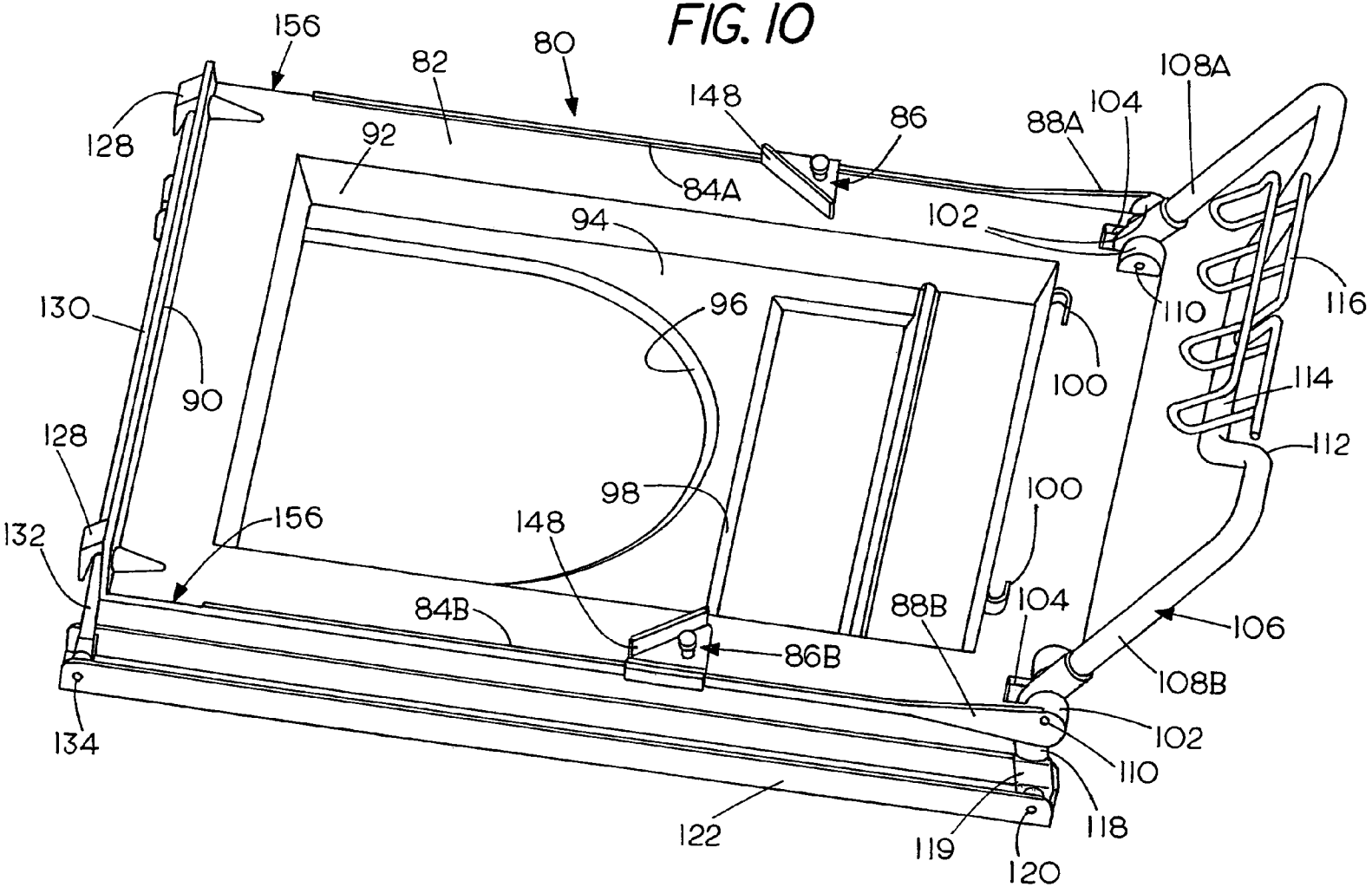
FIG. 10 is a top perspective view of a second embodiment of the paint container support.

The cross shaft 32A is pivotally mounted to an end wall 18 of the paint container support tray (FIG. 9) with pivot blocks 52A. Cross shaft 32A can be mounted to the flange 20B or other walls as desired.

Cross shaft sections 34A are mounted with blocks 52B to end portions of side walls 16 and the arms 42 and 44 and rod 46 are on the outside of the walls 16 and cross the paint support tray above the level of the flange 20B. The cross shaft sections 34A are co-axial and the blocks 52B can be mounted on an end flange 35B or other walls if desired. Flanges or end walls 35A and 35B depend from the flanges 20A and 20B.

Figure 4:
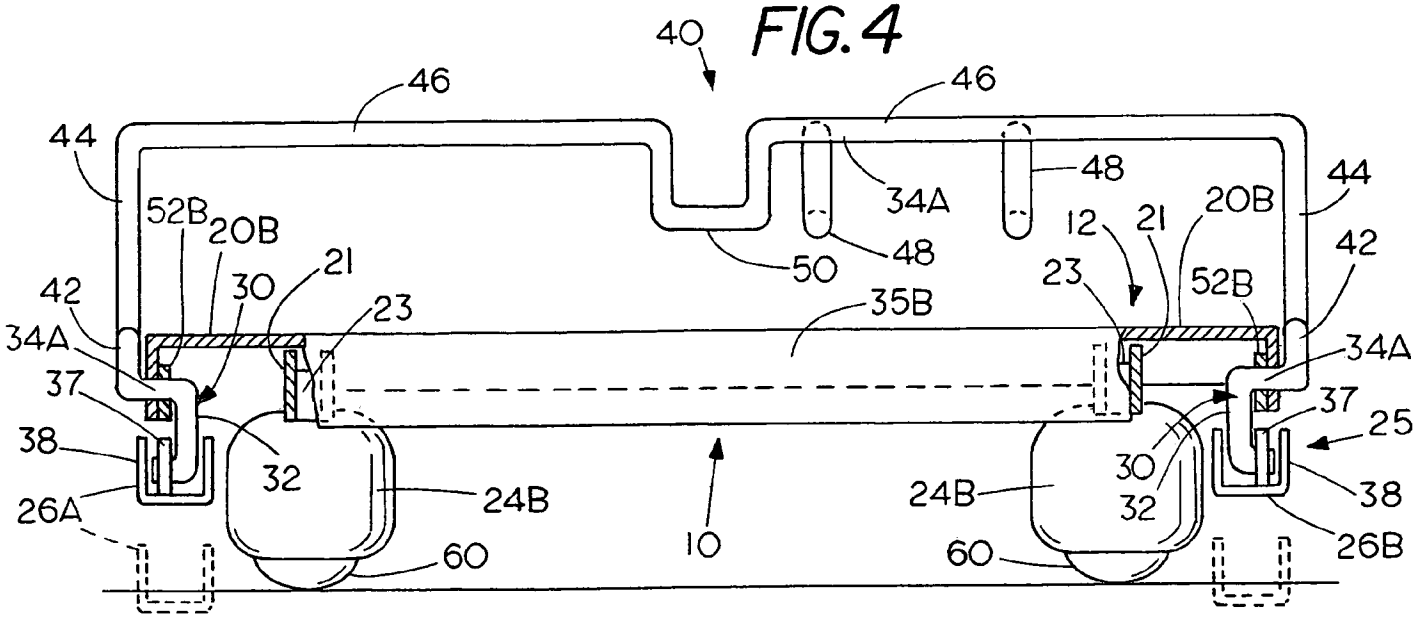
FIG. 4 is an end elevation view of the paint support tray in the position of FIG. 3.

The lower ends of the pairs of links 32 and 34 are connected to the respective ends of both of the rails or runners 26A and 26B, through suitable pivot connections as shown in FIG. 4. The runners or rails 26A and 26B are identical, and it can be seen that they are channel shaped, so that they have a flat bottom wall surface that engages the floor or other supporting surface, and then they have larger ears 38 at the opposite ends that will provide for mounting a bearing or other suitable pivot block or ear 37 for connecting the links 32 and 34. The rails can be replaced with individual legs, but the cross shaft 32A and cross shaft section 34A should be linked to pivot at the same time and the same amount.

The links 32 and 34 as stated are fixed to the respective cross shaft 32A and cross shaft sections 34A, and at the one end of the paint container support tray, the cross shaft sections 34A is connected to an actuator handle or mechanism 40. In this case, the actuator mechanism 40 comprises lever arm 42 on each side of the paint support tray 12 and the lever arms 42 are connected to the cross shaft sections 34A. Upright actuator arms 44 are fixed to the lever arms 42. The arm 44 joins a cross actuator rod 46. The cross actuator rod 46 has a pair of brackets 48 thereon, which are spaced apart, and has an inverted U-shaped member 50 in the center portions.

Figure 3:
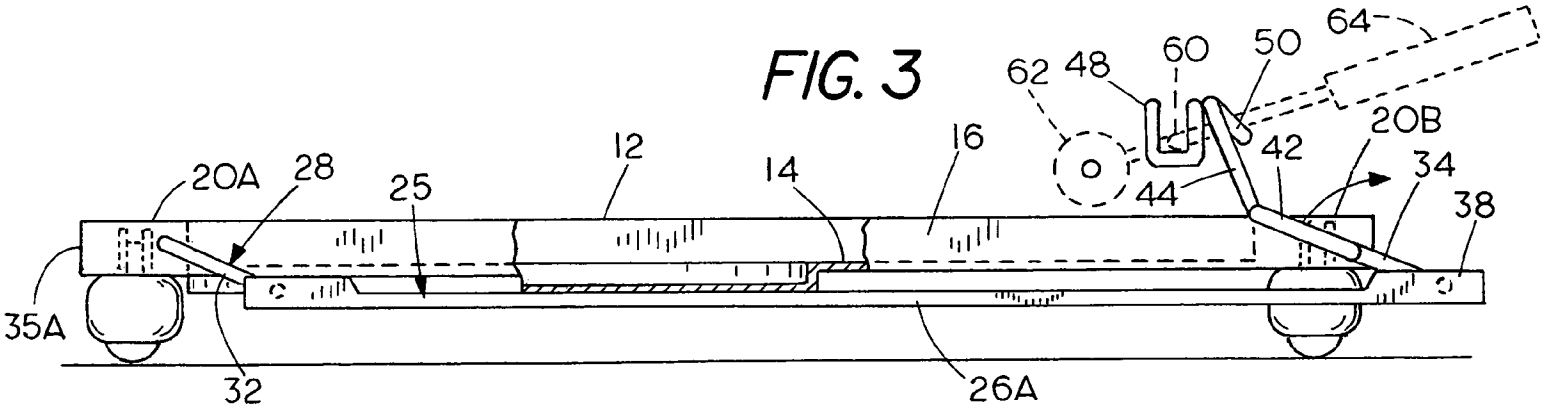
FIG. 3 is a side elevational view of the paint support in a position with the rails raised, so that the casters or rollers comprising mobile supports engage the supporting surface.
Figure 5:
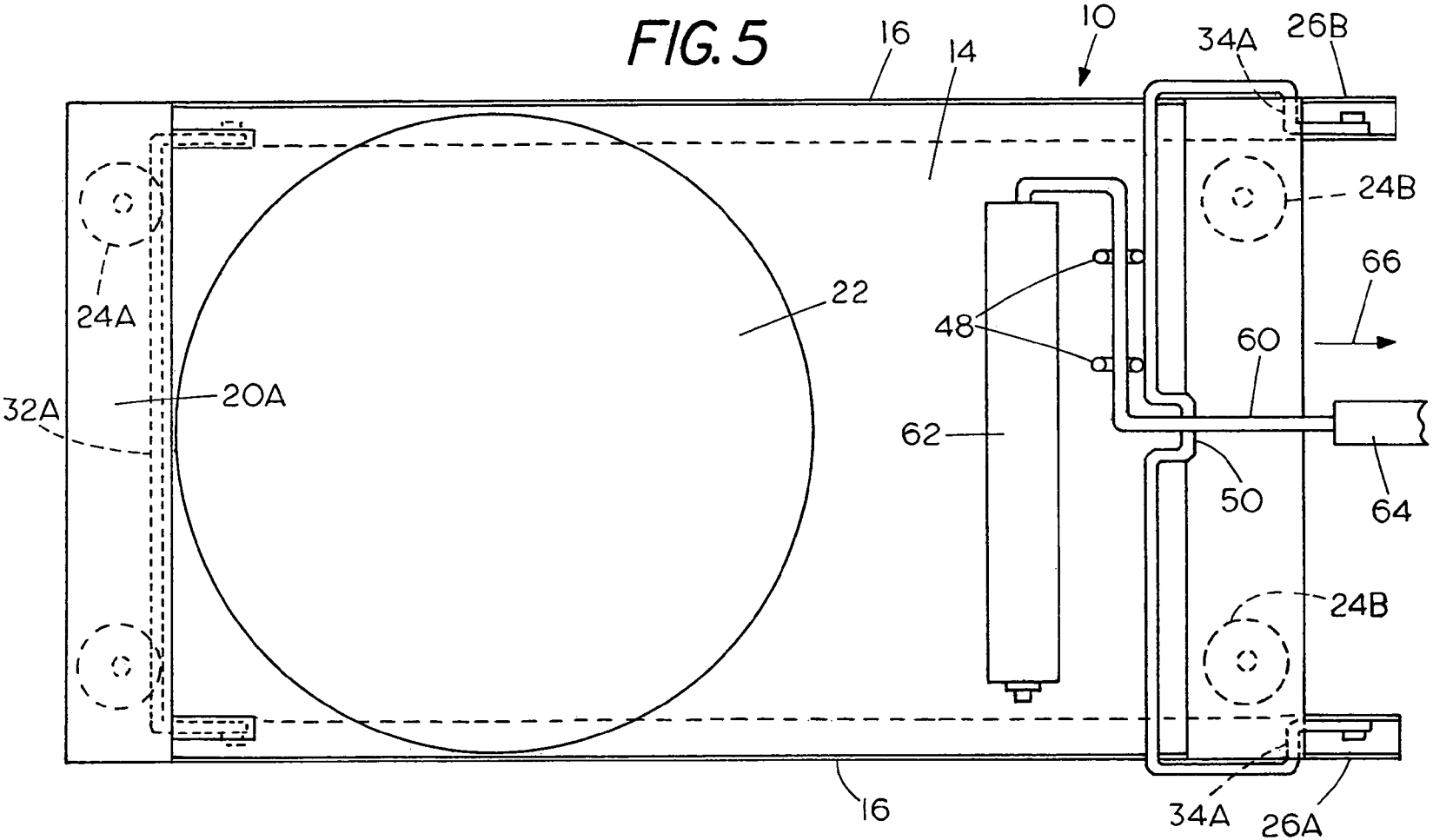
FIG. 5 is a top plan view of the paint support tray with the stabilizing support rails in a raised position when the casters or rollers are engaging the floor.
Figure 6:
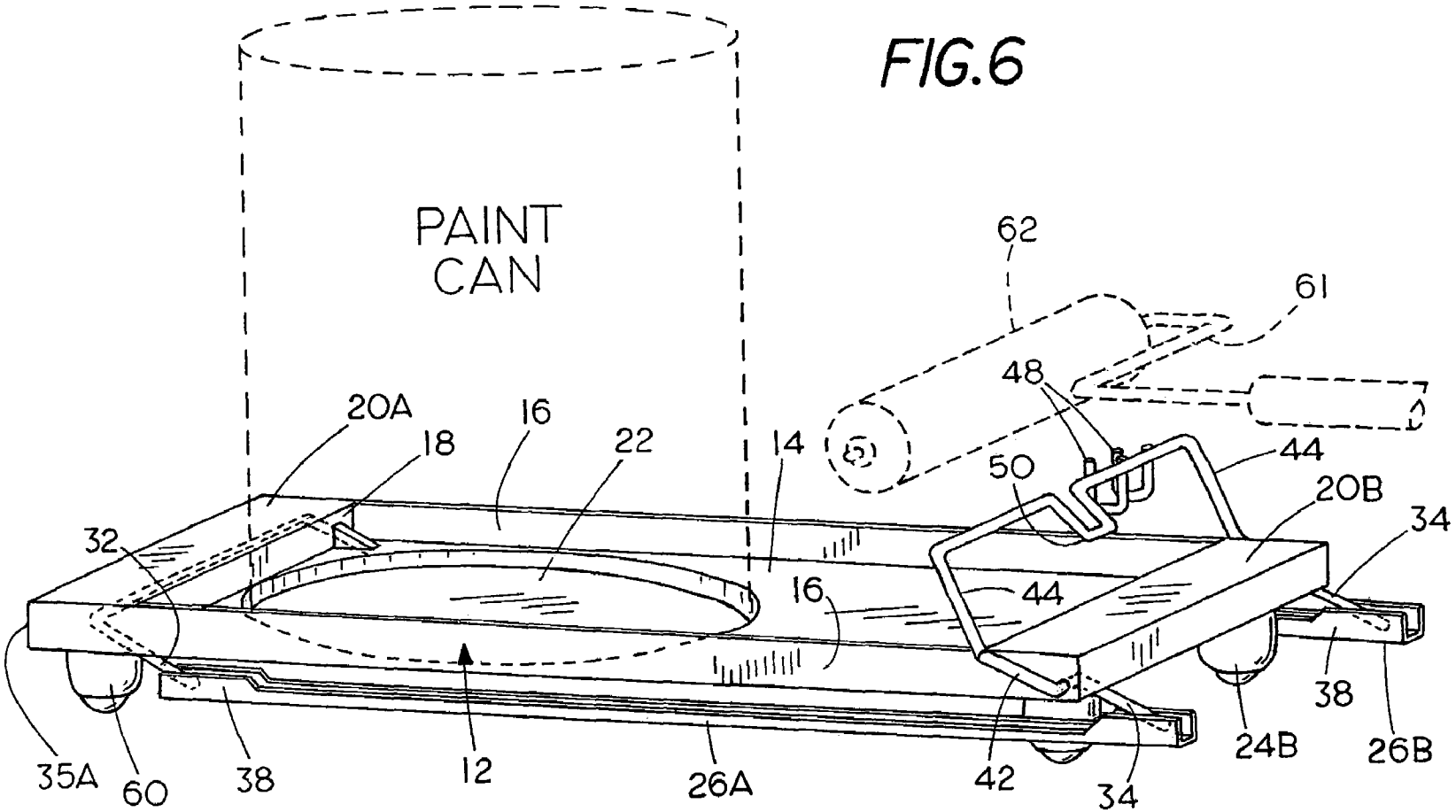
FIG. 6 is a perspective similar to FIG. 1, but with the paint support rails in a raised position and the casters or rollers in position to engage the floor.
Figure 7:
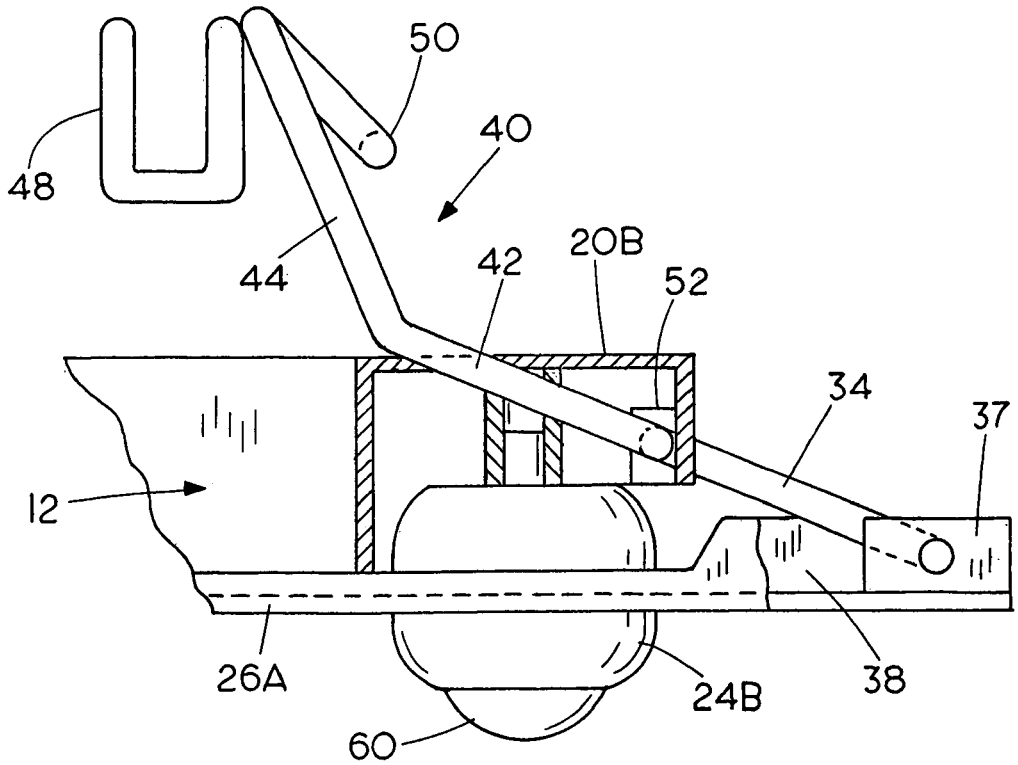
FIG. 7 is an enlarged partial side view of the paint support tray actuator linkage at a first end of the tray.
Figure 8:
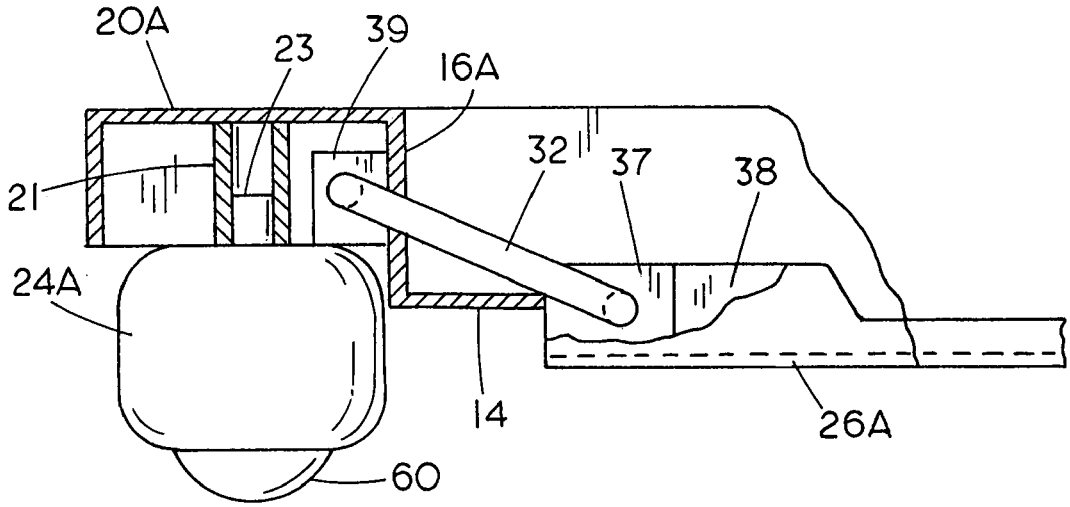
FIG. 8 is an enlarged partial side view of the paint support tray lift linkage at a second end of the paint support tray.

The brackets 48 and the inverted U-shaped member 50 of the cross actuator rod 46 are used for placing a paint roller frame 61 for a paint roller 62 in position shown in FIG. 5. The paint roller frame 61 is hooked on a bracket 48 and rests in the U shaped member 50 so that when the actuator rod 46, is moved by moving the paint roller handle 64 in the direction shown by arrow 66, and acting through the links or arms 44 and lever arm 42 the cross shaft sections 34A and cross shaft 32A pivot on the mountings shown at 52A and 52B. When this occurs, the links 32 and 34 will cause the rails 26A and 26B to be moved upwardly or downwardly relative to the paint support tray depending on the direction of movement of the actuator rod 46. In one position of the rod 46 the rails or runners 26A and 26B are lifted off the floor and the mobile support casters or rollers 24A and 24B will engage the floor (FIGS. 3 and 4). In a second position of the rod 46 the actuator links will move the rails or runners as shown in FIG. 1, to engage the floor and lift the casters or rollers 24A and 24B clear of the floor so that the paint support tray assembly 10 is stable. A suitable paint roller 62 can be loaded with paint from paint directly in the paint support tray, or a tray liner supported thereon, or in a separate conventional roller tray supported on wall 14. In the case of a 5-gallon pail being supported on the paint support tray, a paint roller such as roller 62 can be loaded directly from the pail that is supported on the paint support tray 12.

The preferred mobile supports are of a type of caster that has a free rolling ball shown at 60 in the lower ends of the casters (see FIG. 4) so that they move easily and are not likely to bind. There is no need for a swivel connection at the upper end of the caster housing, although swivel casters or rollers or wheels can be used as well.

Adequate clearance is provided for the linkages and pivoting the actuators for the parallel linkage assembly can be of any desired type. Pivot pins, spherical bearings, bushings, or other types of mounting that are well known in the art can be used.

The actuator rod 40 and brackets 48 and U-shaped member 50 that is shown can also be modified so that it would be a straight up and down lever that can be manually operated, or a unit that would have a different configuration for engagement by a long handled paint roller is represented in dotted lines in FIGS. 3 and 5 for example.

The depending walls 35A and 35B on the flanges 20A and 20B at opposite ends of the paint supply support or paint support tray, shield the casters or rollers from paint.

A second form of the disclosure is illustrated in FIGS. 10-14, and comprises a paint support tray 80 that is has a support panel 82, which could be a planar wall with receptacle configurations as shown. It includes side guide rails or walls 84A and 84B that as will be shown are guide rails for sliding stops 86 that are mounted on the side rails. The side rails 84A and 84B also have raised ear portions adjacent an actuator handle end, which are indicated at 88A and 88B for pivotally mounting the actuator handle assembly as will be explained. The end wall that is remote from the actuator handle is illustrated at 90. The support wall panel 82 has a rectangular recess 92 that extends substantially the full length of the support panel 82 and the recess 92 is formed with a bottom wall 94 that can include a formed receptacle 96 for a five gallon paint can, for example, and a rectangular receptacle 98 for other types of containers or accessories.

The support panel 82 can be provided with clips or stop members 100, adjacent the actuator handle end of the tray.

Support panel 82, as shown, has a pair of raised ears 102 on each side of the tray, and on opposite sides of recesses 104 that are formed in the wall 82. The ears 102 form hubs for pivotally mounting an actuator handle assembly 106 that has a first leg 108A and a second leg 108B spaced apart and mounted with suitable pivot pins 110 to the hubs 102 on the opposite sides of the tray. The handle assembly 106 has a cross assembly member 112 that joins the legs 108A and 108B, and it has a center recessed portion 114, that also supports a wire rack 160 and that can be used for various accessories and also for receiving a paint roller frame for actuating the legs 108A and 108B for movement about the pivot axis of the pins 110. The legs 108A and 108B have a lower bent portions 118 that mount straps 119, that in turn are pivotally mounted with a suitable connection including a pivot pin 120 to longitudinally extending side support rails 122. The portions 118 are reduced in size from the tubular portions of legs 108, to hold the straps 119. Straps 119 are mounted on the pivot pins 120 for pivotally mounting the rails 122 to the arms 108A and 108B. Blocks 124 can be used for properly positioning the lower ends of the straps 119. The legs 108A and 108B act as levers for operating the paint support tray 80.

The rails 122, as shown, are again channel-shaped as in the previous form of the disclosure, and extend along the longitudinal sides of the paint support tray 80 to the end that is remote from the actuator handle assembly 106. At the remote end, the wall 90, as shown, mounts suitable hubs 128, that extend out beyond the wall 90, and form journals for pivotably mounting a cross shaft 130 that has depending legs 132. The lower ends of the legs 132 are pivotally mounted with suitable pins 134 to the remote ends of the support rails 122. It should be understood that the support tray shown in FIGS. 10-14 can easily be molded from a suitable plastic, so that the recesses that are formed in support wall 82 can be arranged as desired. The hubs 128 can also be formed in a molding operation. Cross shaft 130 and the legs 132 can be put into place in any suitable manner.

It can be seen that when the legs 108A ands 108B are pivoted as the entire handle assembly 106 is pivoted, they will cause movement of the side rails 122. Because the cross shaft 130 and legs 132 are joined to the opposite ends of support rails 122, they will pivot like a parallel linkage, and the rails 122 will be raised and lowered relative to the paint support tray when the handle assembly 106 is pivoted.

Figure 11:
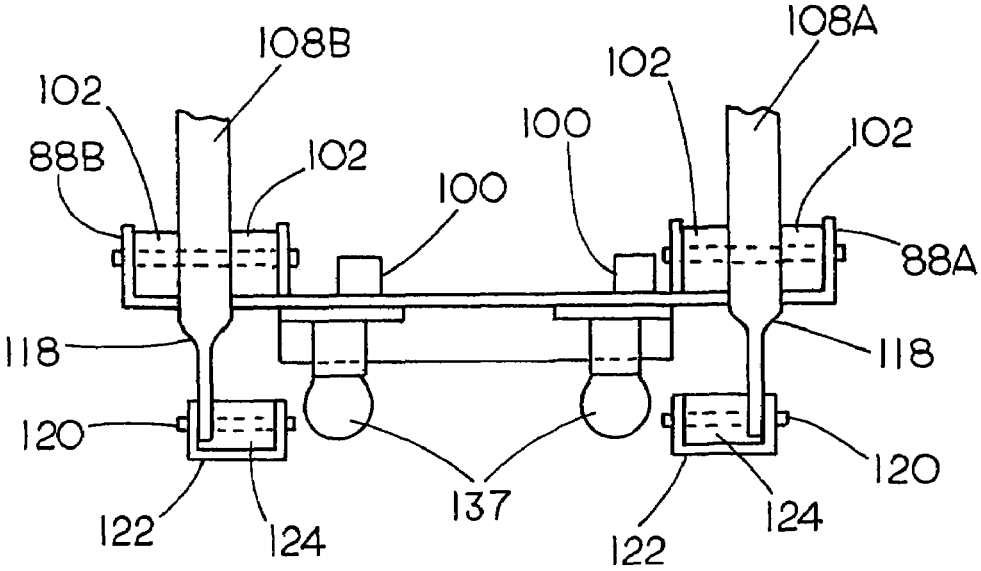
FIG. 11 is a fragmentary end view of the actuator linkage end of the paint tray of FIG. 10.
Figure 12:
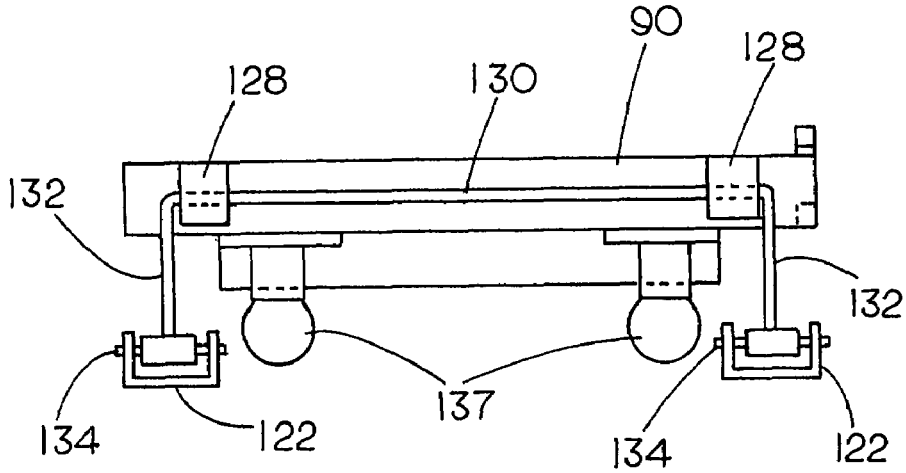
FIG. 12 is a fragmentary end view of the paint tray of FIG. 10 looking at the end opposite from FIG. 11.

Paint containers on the tray will be raised and lowered as the support rails 122 move up and down relative to the tray support wall 82. When the tray is lowered, casters or wheels 137 that are mounted on the tray 80 at the opposite ends will engage the floor or support and the tray 80 can be wheeled for moving the paint container to the desired location. When the tray 80 is raised (the rails or feet are lowered) as shown in FIGS. 11 and 12, for example, the casters clear the floor and the tray 80 is stably supported on the rails 122. The casters used can be made as previously explained.

It also can be seen here that the ends of the straps 119 and legs 132 could have feet on them, if they were joined with a link in some way so they pivoted at the same time, (formed as a parallel link) and the elongated rails 122, while useful and desired, are not absolutely necessary. Non-skid pads can be placed on the bottoms of the rails 122.

Figure 13:
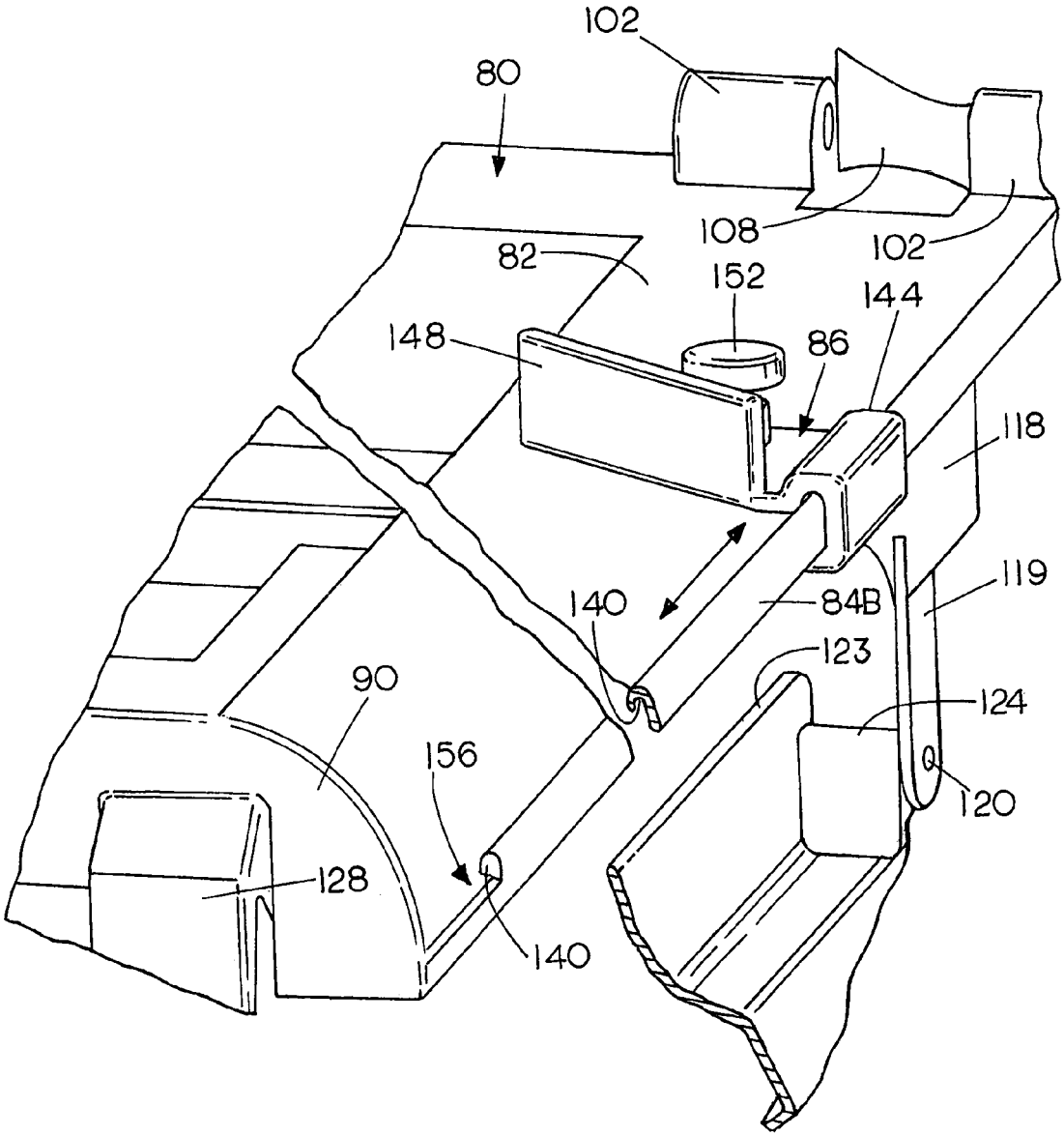
FIG. 13 is a fragmentary side perspective view of the paint tray of FIG. 10 showing an adjustable stop for guiding paint container of different sizes.
Figure 14:
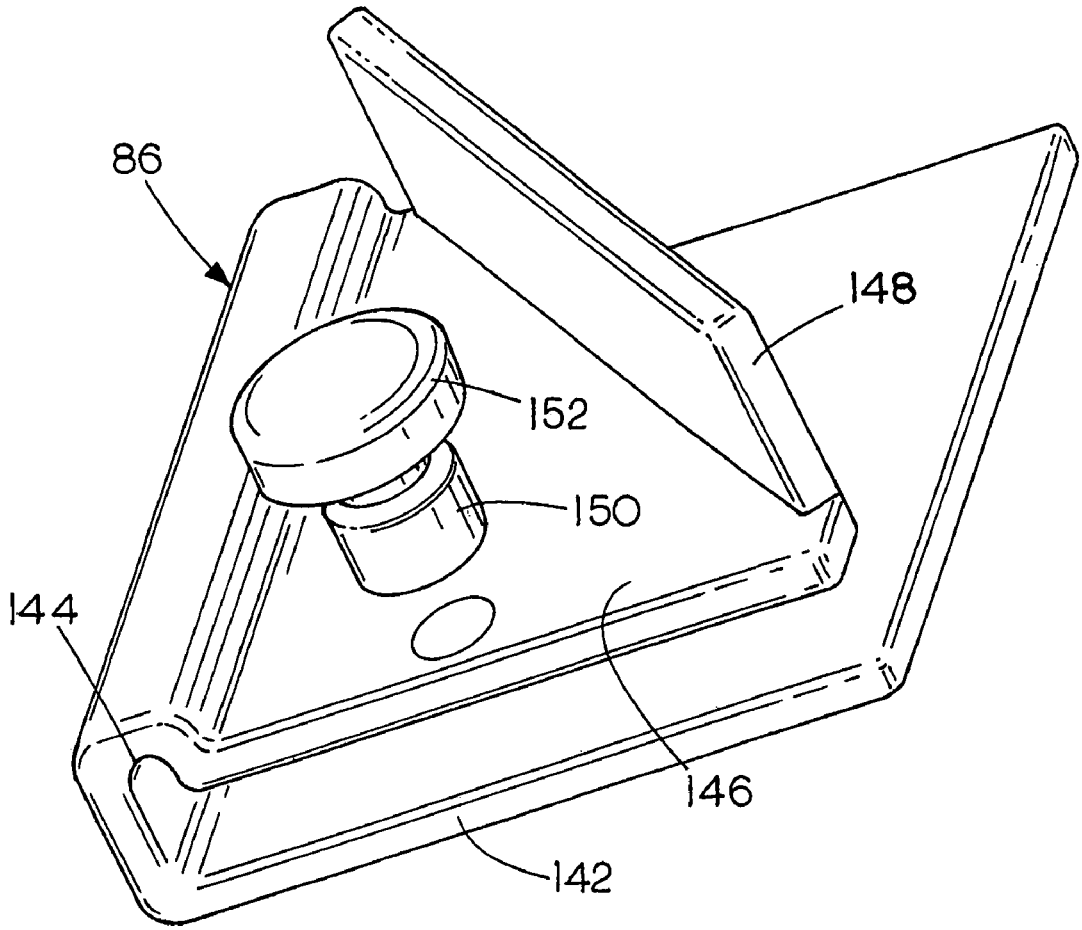
FIG. 14 is an enlarged view of the adjustable stop.

The adjustable stops 86 meet so that they can be moved along the side rails 84A and 84B. FIG. 13 is an enlarged view of the rail 84B. It has a rounded lip 140, that is used as a track or rail for the respective adjustable stop 86A or 86B. The rail 84A also is formed with a rounded lip. As shown in FIG. 14, the adjustable stops 86A and 86B each have a base wall 142 that slides under the support wall 82 of the tray. A track portion 144 extends up along the outside of the respective rail 84A and 84B, and is formed to fit over the rail along the rounded portion 140. A top wall 146 overlies the wall 142, and is positioned on top of the support wall 82 of the tray, and slides along the support wall. An upright stop member 148 is provided on the top of wall 146 and it is at an angle so the adjustable stops can be slid along the rails so the stop members 148 will engage a large can or similar container that would be resting directly on the wall 82, to keep it from sliding back and forth.

A collar 150 is secured to the top wall 146 of the adjustable strap, and has a threaded interior. A hand screw 152 is threaded through the collar 150 and through a provided opening in the wall 142 so that the end of the screw 152 will engage the top of the support wall 82 of the tray for locking the adjustable stop in position along the rails.

Also as shown in FIG. 13, the rails 84A and 84B each have a recess 156 that is of size so that the adjustable stops can be slid down to a location adjacent the remote end wall 90 and then removed, if desired, by loosening the hand screw.

FIG. 13 also shows the molded on hubs 128, and includes a showing of the arm portions 118, and the pivot connection to the end of the support rails 122 adjacent the actuator handle.

Thus, when a paint container is placed onto the support wall 82, or in one of the recesses formed, such as 92, 96, or 98, with the casters 137 raised from the floor, and the paint container is to be moved, the handle assembly 106 will be pivoted and the lever action of legs 108A, and 108B and 132 will move the ends of the legs so that the support rails 122 will be raised relative to the tray. The casters 137 which are mounted in the same manner as in the first form of the disclosure, or directly under the tray in any suitable manner will engage the floor or support surface. Once the tray and supported paint is moved to the desired location, the handle assembly 106 is moved to place the support rails 22 on the floor and raise the casters or support wheels 137 from the floor so that the tray will be stable. The painting then can continue. When it is desired to move the paint supply again, the paint support tray handle assembly 106 is actuated so that the support rails 122 are raised. The casters then engage the ground or floor and the paint container can be easily rolled by moving the paint support tray, for example, by pushing on the handle assembly with the paint roller.

Various brackets can be utilized for engaging a paint roller for moving the tray once the support rails have been raised and the casters are supported on the ground.

The device is easy to use, and provides a stable support for using a paint roller, while simplifying greatly the movement of the paint supply around a room.

The rails can be modified by using feet at the opposite ends of the paint supply tray that are joined by links so the pivoting links 32 and 34 move simultaneously. In some cases only one end of the tray may be lifted and lowered, where wheels or casters at the opposite ends engaging the surface at all times.

Although the present invention has been described with reference to preferred embodiments, workers skilled in the art will recognize that changes may be made in form and detail without departing from the spirit and scope of the invention.

What is claimed is:

1. A paint supply support comprising a paint container support wall, a first rolling surface engagable support for engaging a surface to permit moving the paint supply support across the surface, and a second non-rolling surface engagable support foot, a pivoting linkage couple to the support wall and to one of the first and second supports and mounting the one of the first and second supports on said support wall, one of the first and second supports being moveable as guided by the pivoting linkage from a first position wherein the second support foot engages the surface and the first rolling surface support is raised from the surface, to a second position wherein the second support foot is retracted and the first rolling surface engaging support engages the surface.

2. The paint supply support of claim 1 and an operator member for pivoting the linkage between its first and second positions to move the one of the first and second supports.

3. The paint supply support of claim 2 wherein the second support foot comprise a pair of rails that are elongated and extend substantially the length of the paint supply support, and both ends of the rails being mounted on the pivoting linkage.

4. The paint supply support of claim 2 wherein the operator member has brackets engageable by a paint roller frame for pivoting the linkage to move between its first and second positions.

5. The paint supply support of claim 1 wherein the paint container support wall is of size to receive a 5-gallon can of paint on an upper side.

6. The paint supply support of claim 1 wherein said paint container support wall comprises a panel having a recess that is of size to receive a separate paint container.

7. The paint supply support of claim 5 wherein said paint container support wall has upright side walls thereon, with upper edges to define a tray, and end flanges on opposite ends of the tray, said first rolling supports being mounted below said end flanges.

8. The paint supply support of claim 7 wherein said first rolling supports comprise spherical ball casters to permit universal rolling movement.

9. The paint supply support of claim 2 wherein the pivoting linkage comprises pivoting links at opposite ends of the support wall, said pivoting links supporting a pair of rails that comprise a pair of feet, one rail on each side of the paint supply support, the pivoting links comprising parallel links at the ends of the paint supply support, and wherein the pivoting links include portions on opposite sides of the paint supply support, which portions are joined by cross members at the ends of the paint supply support, the pair of rails being pivotally coupled to free ends of the pivoting links and being substantially parallel.

10. The paint supply support of claim 9 wherein rails are channel shaped and have upright side walls.

11. A paint supply support tray comprising a support wall, and having first and second ends and first and second sides, casters mounted at said first and second ends for supporting the support tray for rolling movement along a supporting surface, parallel linkages on opposite sides of the support tray including a first pair of pivoting links at the first end of the support tray and a second pair of pivoting links of a second end of said support tray, one pivoting link of each pair being on a different side of the support tray, said pivoting links being pivotally mounted on the support tray and having connections to cause the pivoting links on each side of the support tray at each end to move simultaneously, an actuator for pivoting at least one of the pairs of pivoting links, and a separate connecting link on each side of the support tray joined to the pivoting links on such side, said connecting links each having a tray support surface, and the connecting links being of sufficient length such that in a first position of the pivoting links, the tray support surface on each side of the support tray will engage the supporting surface and lift the support tray upwardly so that the casters are spaced from the supporting surface, and in a second position of the pivoting links, the tray support surfaces on each side of the support tray are raised from the supporting surface and the casters support the support tray on the supporting surface.

12. The paint supply support tray of claim 11, wherein said connecting links having the tray support surfaces that are mounted to the pivoting links comprise rails, and the tray support surfaces engage the supporting surface substantially along a length of the paint supply support tray between its first and second ends in the first position of the pivoting links.

13. The paint supply support tray of claim 11 wherein said actuator comprises a bracket portion engageable by a handle of a paint roller for actuating the pivoting links by movement of a paint roller engaging the bracket portion.

14. The paint supply support tray of claim 13 wherein the paint supply support tray has a width between upright side walls of sufficient size to receive a paint roller, and said bracket portion on said actuator being positioned such that when a roller is overlying the paint supply support tray, a handle of such roller is engagable with the bracket portion for actuating the pivoting links.

15. The paint supply support tray of claim 11 wherein the pivoting links at a second end of said paint supply support tray are mounted to the paint supply support tray on cross shaft sections on opposite sides of the paint supply support tray, the pivoting links being connected to first ends of the cross shaft sections, lever arms mounted to second ends of said cross shaft sections on outer sides of the paint supply support tray, and a cross member fixed to said lever arms and positioned upwardly from said paint supply support tray to form the actuator, and whereby the cross member can be moved to cause the cross shaft sections and the associated pivoting links to pivot.

16. The paint supply support tray of claim 11, wherein the support wall has a pair of upright tracks on opposite sides thereon, a separate adjustable stop member on each of said tracks, and locks to hold the stop members in a desired position along the respective track.

17. The paint supply support tray of claim 13 wherein the one set of pivoting links are legs pivoted to the support wall and a cross member spaced from the support wall and fixed to the legs and comprising the actuator.

18. A paint supply support comprising a paint container support wall, first rolling surface engagable supports mounted relative to the support wall and engagable with a surface to permit moving the paint supply support by rolling the paint supply support across the surface, and at least one second non-rolling support mounted relative said support wall, movable linkage coupled to at least one of the first and second supports and the movable linkage being movable between first and second positions, wherein in the first position of the movable linkage the first rolling supports are raised from the surface and the at least one second support engages the surface, and in the second position of the movable linkage, the first rolling supports engage the surface and the at least one second support is raised from the surface to permit rolling the paint supply support along the surface.

19. The paint supply support of claim 18 wherein the movable linkage comprises pivoting links joining the at least one second non-rolling support to the support wall.

* * * * *